US006079603A

United States Patent [19]

Smegal

[11] Patent Number: 6,079,603

[45] Date of Patent: Jun. 27, 2000

[54] UNDER THE COUNTER PAPER TOWEL DISPENSING SYSTEM

[76] Inventor: Thomas V Smegal, 20229 5th Ave., Covington, La. 70433-5566

[21] Appl. No.: 09/107,731

[22] Filed: Jun. 30, 1998

[51] Int. Cl.[7] ..... B26F 3/02

[52] U.S. Cl. ..... 225/1; 225/106

[58] Field of Search ..... 242/419.4, 598, 242/598.5, 598.6; 225/106, 1, 42

[56] References Cited

U.S. PATENT DOCUMENTS

| | | | |
|---|---|---|---|
| D. 317,385 | 6/1991 | Wolff et al. . | |
| 1,141,229 | 6/1915 | Buerger | 242/598 X |
| 1,391,326 | 9/1921 | Killian | 242/599 |
| 2,749,056 | 6/1956 | Jenkins | 242/598.5 X |
| 2,818,221 | 12/1957 | Thieman | 225/67 |
| 2,916,223 | 12/1959 | Klim . | |
| 3,038,676 | 6/1962 | Maver . | |
| 4,097,002 | 6/1978 | Krueger . | |
| 4,454,974 | 6/1984 | Cooke | 225/106 |
| 4,606,510 | 8/1986 | McEntire | 242/55.3 |
| 4,634,033 | 1/1987 | Lloyd | 225/73 |
| 4,762,259 | 8/1988 | Kosa . | |
| 4,771,966 | 9/1988 | Anderson | 225/51 X |
| 5,480,084 | 1/1996 | Daniels . | |
| 5,651,487 | 7/1997 | Hansen | 225/106 |

*Primary Examiner*—Rinaldi I. Rada
*Assistant Examiner*—T. Anthony Vaughn
*Attorney, Agent, or Firm*—Joseph T. Regard, Ltd plc

[57] ABSTRACT

A paper towel dispensing rack designed for ease of installation and use, the preferred embodiment of the present system configured to be placed within the sink cabinet of kitchen cabinet, in such a manner that the rack is supported by a cabinet beam horizontally situated over the cabinet door. Unlike prior art systems, the rack of the present system supports the sheet to be dispensed such that it is easily accessible through a closed door, upon opening the door, as desired, but without the towel roll and rack blocking access to the cabinet or taking up unwanted space. The preferred embodiment of the invention utilizes a c-clamp structure to secure the rack to a horizontal beam commonly found in most kitchen cabinets supporting a sink, mounting the rack in a secure, yet removable fashion. The present system contemplates a towel holder mechanism to suspend at least a portion of the towel to be dispensed in a generally horizontal fashion, teaching a first embodiment utilizing a spring biased holding bar, and a second embodiment contemplating an elastic holder member.

3 Claims, 3 Drawing Sheets

UNDER THE COUNTER PAPER TOWEL DISPENSING SYSTEM

TECHNICAL FIELD OF THE INVENTION

The present invention relates to sheet dispensers, and in particular to a paper towel dispensing rack designed for ease of installation and use, the preferred embodiment of the present system configured to be placed within the sink cabinet of kitchen cabinet, in such a manner that the rack is supported by a cabinet beam horizontally situated over the cabinet door. Unlike prior art systems, the rack of the present system supports the sheet to be dispensed such that it is easily accessible through a closed door, upon opening the door, as desired, but without the towel roll and rack blocking access to the cabinet or taking up unwanted space.

The preferred embodiment of the invention utilizes a c-clamp structure to secure the rack to a horizontal beam commonly found in most kitchen cabinets supporting a sink, mounting the rack in a secure, yet removable fashion.

The present system contemplates a towel holder mechanism to suspend at least a portion of the towel to be dispensed in a generally horizontal fashion, teaching a first embodiment utilizing a spring biased holding bar, and a second embodiment contemplating an elastic holder member.

BACKGROUND OF THE INVENTION

While the prior art has contemplated literally hundreds of designs for paper towel racks or holders, none are believed to contemplate the teachings of the present invention.

The following patents were deemed at least generally pertinent to the present invention:

| Patent Number | Inventor(s) | Date of Issue |
|---|---|---|
| Des317,385 | Wolff et al | 06/11/1991 |
| 2916223 | Kilm | 12/08/1959 |
| 3038676 | Mayer | 06/12/1962 |
| 4762259 | Kosa | 08/09/1988 |
| 4097002 | Krueger | 06/27/1978 |
| 5480084 | Daniels | 01/02/1996 |

While the prior art may illustrate that the concept of mounting a paper roll under a sink, to provide an out of the way, yet easily accessible area for placement of the roll is not entirely new, such approaches are believed distinguishable from that contemplated in the present invention. See, for example, Pat. No. 2,916,223 issued 1959, which structurally is distinguishable, contemplating a mount to the sink drain which would provide more effort to use than the present invention.

Pat. Nos. 4,097,002 and 3,038,676 illustrate standard paper towel designs.

Based upon the above cited patents, it is submitted that the present, applied for invention contemplates a unique and novel system for dispensing paper towels and similar sheet commodities.

GENERAL, SUMMARY DISCUSSION OF THE INVENTION

Unlike the prior art, the present invention contemplates a sheet commodity dispensing system which provides an ease of installation and use superior to that contemplated in the prior art.

While literally hundreds of paper towel designs have been patented over the years, there still would appear to exist in installing the dispenser or rack in an out of the way, yet easily accessible location. Paper towel racks installed on cabinet doors block access to the interior of the cabinet, and the nature of the installation, wherein the rack must move when the door is opened, provides problems of stability. On the other hand, racks mounted within the cabinet generally block the use of limited storage space; further, situated within the cabinet, the user generally has to bend under the cabinet and reach within same, providing difficulty in access.

The present device, rather, is designed to provide an ease of installation and use not found in prior art systems. It has been found that the space above the cabinet door, within the cabinet, is not generally utilized for storage by the user. But with this mounting location, a traditional paper towel rack would require the user to still open the cabinet door, reach in and find the towel to be dispensed, and dispense same, providing some difficulty and effort.

However, the rack of the present system is designed to overcome this shortcoming, allowing the mounting of the present system within the cabinet above the door, while providing an easily accessed and dispensed sheet upon demand. The present system even allows dispensing of towels through a closed cabinet door, nonetheless providing a hidden system to the casual observer.

The rack present invention is configured to be placed within the sink cabinet of kitchen cabinet, in such a manner that the rack is supported by a cabinet beam horizontally situated over the cabinet door. As indicated, the rack of the present system supports the sheet to be dispensed such that it is easily accessible through a closed door, upon opening the door, as desired, but without the towel roll and rack blocking access to the cabinet or taking up unwanted space.

The preferred embodiment of the invention utilizes a c-clamp structure to secure the rack to a horizontal beam commonly found in most kitchen cabinets supporting a sink, mounting the rack in a secure, yet removable fashion.

The present system further contemplates a towel holder mechanism to suspend at least a portion of the towel to be dispensed in a generally horizontal fashion, teaching a first embodiment utilizing a spring biased holding bar, and a second embodiment contemplating an elastic holder member.

It is therefore an object of the present invention to provide a system for supporting paper towels or other dispensed sheet commodities in an unused, yet relatively easily accessible area of cabinet space.

It is another object of the present invention to provide a system dispensing paper towels which is more accessible and easier to use than prior art systems.

It is still another object of the present invention to provide a paper towel dispensing system which dispenses towels through a closed cabinet door, yet does not block access to the interior of the cabinet.

Lastly, it is an object of the present invention to provide a paper towel dispensing system which is easier to use, install, and maintain than predecessor systems.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
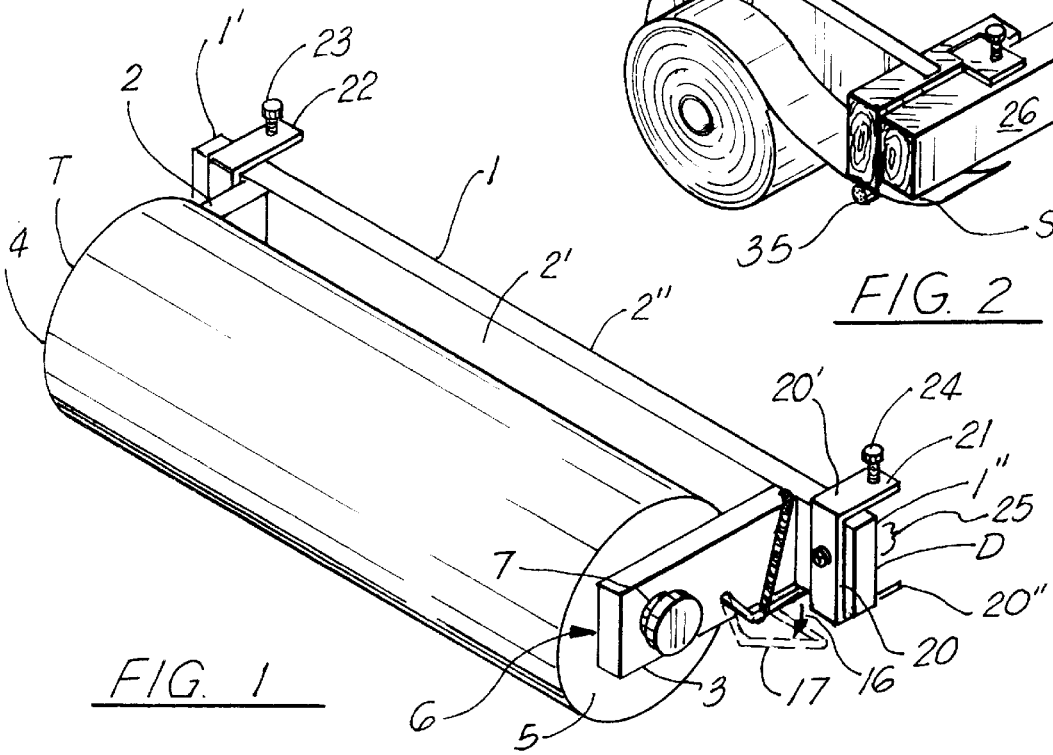
FIG. 1 illustrates an isometric view of the preferred embodiment of the present invention, illustrating a spring biased holding bar to retain the towel to be dispensed from the towel roll.

Referring to FIG. 1, the preferred embodiment of the rolled sheet dispenser D for dispensing paper towel sheets or the like from a roll T includes a main body 1 having first 1' and second 1" ends, respectively, and a front 2' and back 2" face, respectively, the main body shown having a generally rectilinear configuration, and being formed of wood, plastic, metal, or other material.

Situated at the first 1' and second 1" ends, and emanating from the front 2' face of the main body 1 is first 2 and second 3 lateral support arms, respectively, each arm having retaining means to retain opposing ends 4, 5, respectively, of roll T in a pivotal fashion about its longitudinal axis. As shown in the illustrated example, a support bar 7 is provided to pass through a core 6 situated along the longitudinal axis of roll T, allowing roll T to pivot about said support bar 7, with bar is retained at its respective ends by lateral support arms 2, 3, by, for example, a bar retaining aperture formed in each of said support arms 2, 3.

Another alternative means of holding the roll may include, for example, allowing the support arms to outwardly pivot on the main body, in such a manner as to allow the end of support arms distal to the main body to be spread apart, such that a roll may be placed therebetween, and a retaining member situated within said support arms would engage a core formed along the longitudinal axis in roll T, upon pivoting the support arms inward.

Figure 6:
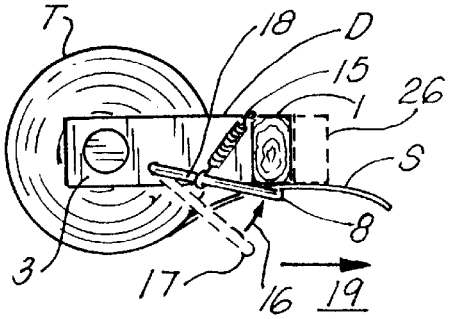
FIG. 6 is an end view of the invention of FIG. 1, illustrating the biased action of retaining arm (18) against sheet (S).
Figure 7:
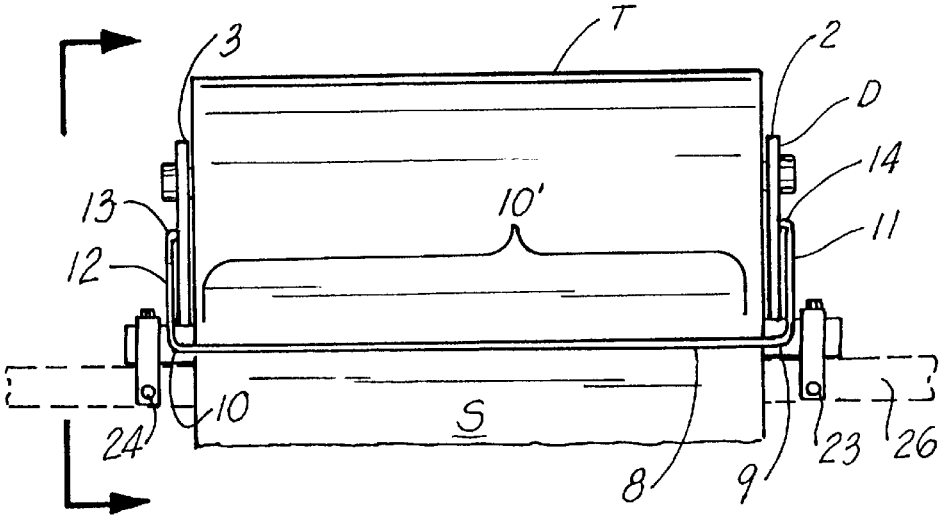
FIG. 7 is a bottom view of the invention of FIG. 6 illustrating the retaining arm (18) against sheet (S), and the generally horizontally situated nature of the sheet to be dispensed (S).

Continuing with FIGS. 6 and 7, the dispenser D further includes a retaining arm 8 for retaining the next sheet S to be dispensed from the roll, the exemplary embodiment of the retaining arm of, for example, metal or plastic, the retaining harm having first 9 and second 10 ends with a medial, sheet engaging area 10' therebetween, the first 9, and second 10 ends having emanating therefrom first 11 and second 12 lateral support arms, respectively, pivotally connected 13, 14 respectively to first 2 and second 3 lateral support arms, respectively.

As shown in FIG. 6, retaining arm 8 is biased 15 by spring 15 or the like, which may include first and second ends, the first end affixed to retaining arm 3, the second end affixed to retaining arm 8, so as to provide bias pulling 16 retaining arm 8 against main body 1, such that retaining arm may be pivoted to an open position 17, to allow the passage of the next sheet S to be dispensed between the retaining arm and the main body, then allowing the bias pull 16 the retaining bar into a holding position 18, retaining the sheet to be dispensed in a firm, yet removable position between the retaining arm and the main body, so that the sheet may be pulled 19 away from the roll to dispense same.

Continuing with the FIG. 1, in use, the main body 1 of the unit is installed to a support or beam (26 in FIGS. 6 and 7), which may be part of a structure inside of a cabinet via first 22 and second 21 "C" clamps situated at first 1' and second 1" ends of main body, the "C" clamps situated so as to emanate from the back face 2" of main body 1. Each "C" clamp includes a main body 20, having first and second ends with first 20' and second 20" lateral engagement members emanating therefrom, respectively; the main body may include screw apertures or the like for affixing same to the front face 2' of main body 1, for example. Each of the lateral engagement members 20', 20" forming the "C" clamp is spaced 25 to allow the passage 27 of a support beam 26 or the like therebetween (as shown in FIG. 9), and may include screws 23, 24 for engaging the clamps to a beam, in order to firmly support the dispenser upon said beam (as shown in FIG. 1).

An alternative design of the main body could include a "C" configured extruded plastic or metal body, arranged so that the lateral arms forming the "C" could form the bracket for installation to a beam dispensing with the necessity of separate "C" clamps. For more information, see the discussion of the third embodiment, below.

Figure 3:
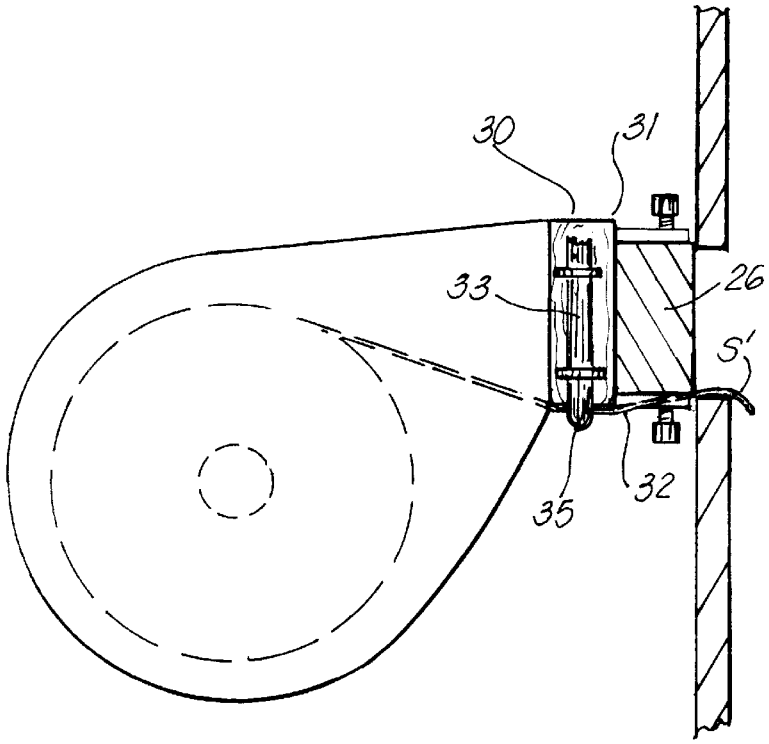
FIG. 3 is an end view of the invention of FIG. 2.
Figure 2:
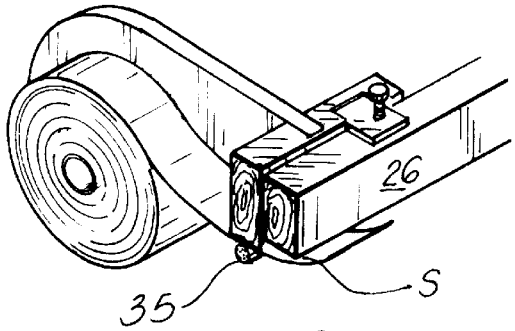
FIG. 2 is an isometric, cross-sectional view of an alternative embodiment of the invention of FIG. 1, illustrating an elastic holding member retaining the towel to be dispensed from the towel roll.
Figure 5:
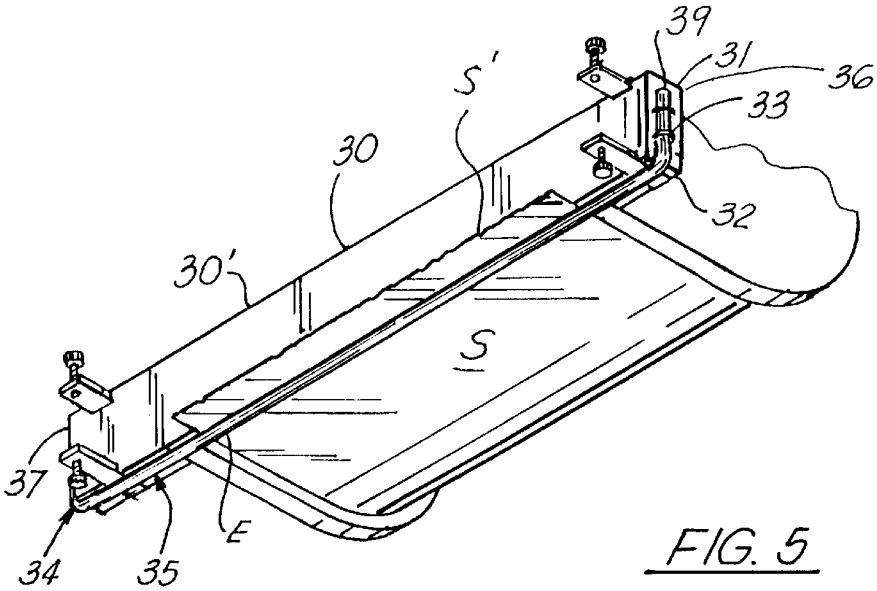
FIG. 5 is an isometric view of the invention of FIG. 4, illustrating a lower view of the embodiment, including the elastic holding member (35) engaging the sheet to be dispensed (S), and the resulting generally horizontal configuration of the sheet to be dispensed (S).

Referring to FIGS. 2, 3, and 5, an alternative embodiment 30 of the dispenser of the present invention utilizes an elastic cord to provide a holding means for retaining the sheet to be dispensed adjacent to the main body. As shown, the main body 30' has first 36 and second 37 ends, an upper edge 31 and a lower edge 32. An elastic member, which might comprise a ⅓ inch diameter, cloth covered elastic "bungee" cord or the like is provided having first 33 and second 34 ends, with a medial holding area 35 therebetween configured to engage the lower edge 32 of the main body, so that the sheet to be dispensed S may be placed therebetween to hold same in place. The elastic band E may be anchored to the main body via staples 39 or the like driven into the main body first and second ends, for example.

Figure 9:
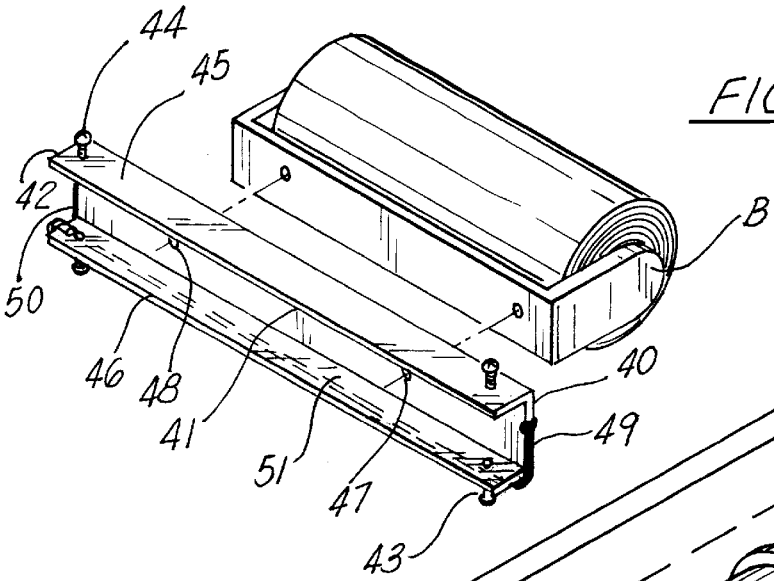
FIG. 9 is an isometric view of a second alternative embodiment of the present invention, illustrating an adapter bracket (39) to convert a standard paper towel bracket (B) into a dispenser under the present invention.

A third embodiment 40 of the present invention is shown in FIG. 9. As shown, the present invention may be provided in the form of a universal adapter bracket which is configured to engage and convert an existing, standard configuration paper towel dispenser into the rack of the present invention. As shown, the main body 41 has first 42 and second 43 ends, and may be of a rectilinear design as disclosed above, with "C" clamps for mounting, or, as shown, may have a body having a "C" configuration, which may be formed in metal or plastic or the like via extrusion or the like. In the "C" configuration body, there is provided top 45 and bottom 46 lateral support members, which may have mounted threadingly thereupon mounting screws 44 for mounting the unit to a beam or the like between the lateral support members, and may have further formed therein screw holes 47, 48 for mounting a standard roll dispenser bracket B thereupon, thereby forming the mounting bracket. An elastic band 51 is provided, which may be mounted to the main body 41 at its first 49 and second 50 ends, respectively. In operation, the sheet to be dispensed is placed between the elastic band and the main body, holding the sheet in the appropriate position for dispensing.

Figure 8:
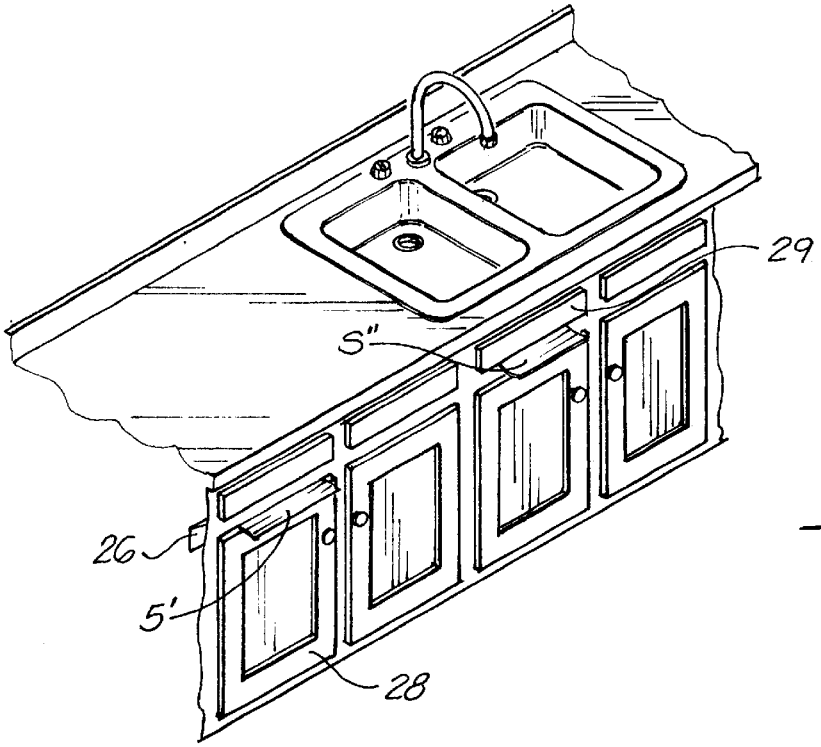
FIG. 8 is an isometric, partially cut-away view of an exemplary installation of the invention of FIGS. 1 or 2, illustrating sheets (S', S") to be dispensed situated in generally horizontal fashion, threaded through drawer (28) and door (29) passages, respectively.
Figure 4:
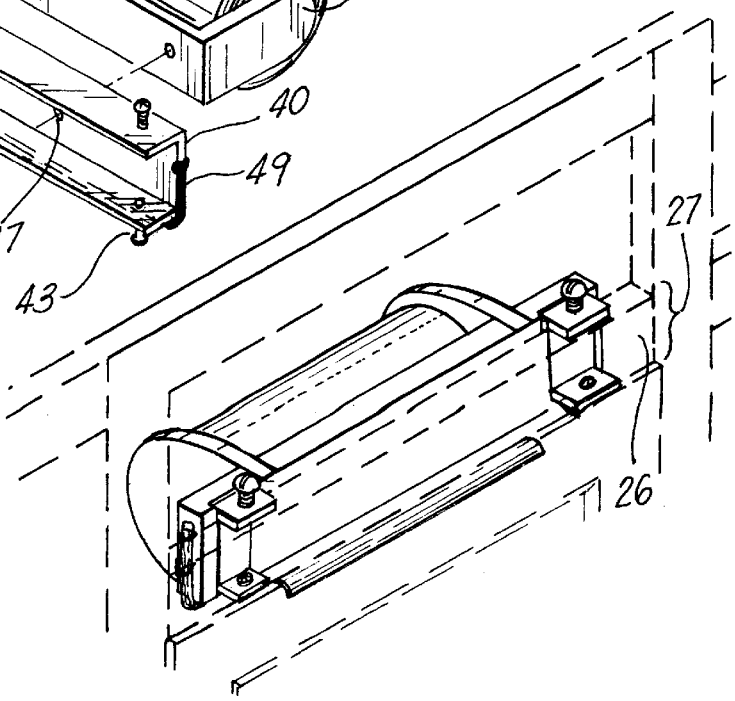
FIG. 4 is an isometric view of the invention of FIG. 3, illustrating the unit situated upon beam (26) in an exemplary kitchen cabinet installation.

Referring to FIG. 8, in installing the present invention, the mounting bracket (or "C" clamps) of the unit is mounted to a beam 26 which may be inside of a kitchen or workshop cabinet or the like. The present invention is particularly useful in mounting in the cabinet under the sink, providing an out of the way, yet easily accessible area for dispensing the towels. Referring to FIGS. 4 and 8, the "C" clamps or mounting bracket is situated to engage beam 26 and the screws (which may be, for example, Phillips head or thumb screws) are tightened to provide a firm connection. The bracket is situated such that the retaining bar, elastic member or other sheet holding means is adjacent to the bottom of the beam, which is ideally adjacent to a door 28, allowing the sheet to be dispensed S' to be immediately accessible when the door is opened, or may even be threaded through the door opening, and above the door, which may be then closed, so as to allow one to pull and dispense a towel through the closed door, dispensing with the necessity of having to open the door to dispense a towel.

This same mounting may be accomplished with a drawer, in which case, the retaining means could be turned about so as to be the upper portion of the main bar, so that the sheet S may be dispensed through the lower portion of a drawer 29. Whether by utilizing "C" clamps, "C" configured main body, or other means, the operation would be the same.

In summary, a method of use in the present invention may be as follows:

The method of dispensing a sheet having a length from a roll of sheets, from a cabinet having an opening formed therein having a periphery, said opening formed within the cabinet leading to a into a storage area formed within said cabinet, said storage area having a support situated within said storage area generally along said periphery of the opening, the method comprising the steps of:

a. providing a dispenser system for dispensing a sheet from a roll of sheets having a longitudinal axis, comprising:
   - a main body having a length, a longitudinal axis, first and second ends, a first side, a second side, a top edge, and a bottom edge;
   - roll holder means for holding the roll of sheets, said roll holder means retaining said roll of sheets adjacent to said main body such that said longitudinal axis of said roll is in general parallel alignment with said longitudinal axis of said main body;
   - a sheet holder configured to interface with said main body, said sheet holder having a length having a longitudinal axis, said longitudinal axis of said sheet holder generally aligned to said longitudinal axis of said main body;
   - bias means for urging said sheet holder along a portion of the length of said main body, said bias means configured to support a portion of the sheet adjacent to said main body, while allowing said sheet to be pulled lengthwise from the vicinity of said main body, dispensing same;
   - mounting means to mount said second side of said main body to the support;

b. mounting said second side of said main body to said support, such that said roll holder means is situated adjacent to the periphery of said door opening;

c. mounting the roll of sheets to said roll holder means;

d. spooling said roll of sheets on said roll holder means, providing an undispensed sheet on said roll, said undispensed sheet having an unattached end;

e. pulling said sheet holder away from said main body, forming a space between said sheet holder and said main body;

f. sliding said undispensed sheet between said space between said sheet holder and said main body, such that the unattached end of the sheet is adjacent to said periphery of said door opening;

g. allowing said bias means to urge said sheet holder along a portion of the length of said main body, retaining a portion of said sheet to be dispensed against said main body;

h. grasping a portion of the unattached end of said undispensed sheet, and pulling said undispensed sheet away from said roll and through said opening; and i. separating said undispensed sheet from the roll of sheets, forming a dispensed sheet.

Further, the method may include the steps of pulling a portion of said undispensed sheet out of said cabinet, and closing an adjacent door (or drawer, if the main body is mounted adjacent thereto), such that said portion of said undispensed sheet is accessible with said door closed, allowing the user access to sheets without the necessity of opening the door.

Thus presented, the present invention provides an easily utilized and installed roll towel dispenser, at considerable space efficiency when compared to other systems.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

ELEMENTS
of the Invention

Date: Sunday, June 28, 1998 10:42 am
Client: Smegal
Title: Under the Counter Paper Towel Dispensing System

| Element | Description |
|---|---|
| T | Towel Roll |
| D | Dispenser |
| S | Towel Sheet |
| 1 | main body |
| 1',1" | First, second ends |
| 2',2" | front face, back face |
| 2 | first lateral support arm |
| 3 | second lateral support arm |
| 4 | first end roll |
| 5 | second end roll |
| 6 | passage therethrough |
| 7 | support bar |
| 8 | retaining arm |
| 9 | first end |
| 10 | second end |
| 11 | lateral arm first |
| 12 | second lateral arm |

-continued

ELEMENTS
of the Invention

Date: Sunday, June 28, 1998 10:42 am
Client: Smegal
Title: Under the Counter Paper Towel Dispensing System

| Element | Description |
|---|---|
| 13 | pivotal connection first |
| 14 | pivotal connection second |
| 15 | spring bias |
| 16 | bias |
| 17 | pulled away |
| 18 | biased arm against sheet |
| 19 | pull away |
| 20 | |
| 21 | first "C" clamp |
| 22 | second "C" clamp |
| 23 | first screw |
| 24 | second screw |
| 25 | space in "C" clamp |
| 26 | beam |
| 27 | width |
| 28 | drawer |
| 29 | door |
| 30 | second embodiment - base member |
| 31 | upper edge |
| 32 | lower edge |
| 33 | elastic member first end |
| 34 | elastic member second end |
| 35 | elastic member medial area |
| 36 | first end |
| 37 | second end |
| 38 | |
| 39 | |
| 40 | third embodiment |
| 41 | main body |
| 42 | first end |
| 43 | second end |
| 44 | screw |
| 45 | top lateral member |
| 46 | bottom lateral member |
| 47 | screw hole |
| 48 | screw hole |
| 49 | elastic first end |
| 50 | elastic second end |
| 51 | elastic medial therebetween |

What is claimed is:

1. The method of dispensing a sheet having a length from a roll of sheets, from a cabinet having an opening formed therein having a periphery, said opening formed within the cabinet leading into a storage area formed within said cabinet, said storage area having a support situated within said storage area generally along said periphery of the opening, the method comprising the steps of:

a. providing a dispenser system for dispensing a sheet from a roll of sheets having a longitudinal axis, comprising:

a main body having a length, a longitudinal axis, first and second ends, a first side, a second side, a top edge, and a bottom edge;

roll holder means for holding the roll of sheets, said roll holder means retaining said roll of sheets adjacent to said main body such that said longitudinal axis of said roll is in general parallel alignment with said longitudinal axis of said main body;

a sheet holder configured to interface with said main body, said sheet holder having a length having a longitudinal axis, said longitudinal axis of said sheet holder generally aligned to said longitudinal axis of said main body;

bias means for urging said sheet holder along a portion of the length of said main body, said bias means configured to urge said sheet holder to support a portion of the sheet adjacent to said main body, while allowing said sheet to be pulled lengthwise from the vicinity of said main body, dispensing same;

mounting means to mount said second side of said main body to the support;

b. mounting said second side of said main body to said support, such that said roll holder means is situated adjacent to the periphery of said door opening;

c. mounting the roll of sheets to said roll holder means;

d. spooling said roll of sheets on said roll holder means, providing an undispensed sheet on said roll, said undispensed sheet having an unattached end;

e. pulling said sheet holder away from said main body, forming a space between said sheet holder and said main body;

f. sliding said undispensed sheet between said space between said sheet holder and said main body, such that the unattached end of the sheet is adjacent to said periphery of said door opening;

g. allowing said bias means to urge said sheet holder along a portion of the length of said main body, retaining a portion of said sheet to be dispensed against said main body;

h. grasping a portion of the unattached end of said undispensed sheet, and pulling said undispensed sheet away from said roll and through said opening; and i. separating said undispensed sheet from the roll of sheets, forming a dispensed sheet.

2. The method of claim 1, wherein the cabinet further has provided therein a door having an open position and a closed position, said door generally engaging the periphery of the opening formed in the cabinet in the closed position, blocking passage through same, said door pivoting away from said periphery of the opening formed in the cabinet in the open position, allowing passage through same, and wherein, after step "h", there is further provided the step of pulling a portion of said undispensed sheet out of said cabinet, and closing said door, such that said portion of said undispensed sheet is accessible with said door closed.

3. The method of claim 1, wherein the cabinet further has provided therein a drawer having an open position and a closed position, said drawer generally engaging the periphery of the opening formed in the cabinet in the closed position, blocking passage through same, said door pivoting away from said periphery of the opening formed in the cabinet in the open position, allowing passage through same, and wherein, after step "h", there is further provided the step of pulling a portion of said undispensed sheet out of said cabinet, and closing said drawer, such that said portion of said undispensed sheet is accessible with said drawer closed.

* * * * *